US005651729A

United States Patent [19]

Benguerel

[11] Patent Number: 5,651,729

[45] Date of Patent: Jul. 29, 1997

[54] GRINDING WHEEL, GRINDING RIM FOR A GRINDING TOOL, AND METHOD OF MANUFACTURING A GRINDING TOOL

[75] Inventor: Robert Benguerel, Sutz, Switzerland

[73] Assignee: Diametal AG, Biel/Bienne, Switzerland

[21] Appl. No.: 315,542

[22] Filed: Sep. 30, 1994

[30] Foreign Application Priority Data

Oct. 15, 1993 [CH] Switzerland ..... 03119/93

[51] Int. Cl.[6] ..... B24D 3/00

[52] U.S. Cl. ..... 451/541; 451/540; 451/544; 51/295; 51/298; 51/300

[58] Field of Search ..... 451/540, 541, 451/544; 51/295, 298, 300

[56] References Cited

U.S. PATENT DOCUMENTS

| | | | |
|---|---|---|---|
| 4,770,907 | 9/1988 | Kimura | 51/307 |
| 5,185,012 | 2/1993 | Kelly | 51/295 |

FOREIGN PATENT DOCUMENTS

| | | |
|---|---|---|
| 0 012 631 | 6/1980 | European Pat. Off. . |
| 0 444 824 | 9/1991 | European Pat. Off. . |
| 0 546 732 | 6/1993 | European Pat. Off. . |

OTHER PUBLICATIONS

DE Beers Ind. Diamond, ZA 7 807 071, Jan. 3, 1980, *Database WPI,* Section CH, Week 8021, Derwent Pub. Ltd., abstract.

Noritake Dia. K.K., JP 01 183 370, Jul. 21, 1989, *Patent Abstracts of Japan,* vol. 13, No. 469, Oct. 24, 1989. Abstract.

Matsushita Electric Ind. Co., JP 6 015 572, Jan. 25, 1994, *Patent Abstracts of Japan,* vol. 18, No. 217, Apr. 19, 1994, Abs.

*Primary Examiner*—Eileen Morgan
*Attorney, Agent, or Firm*—Spencer & Frank

[57] ABSTRACT

A grinding wheel for a grinding tool, includes a grinding wheel core; and a grinding rim which is provided on the grinding wheel core and which is composed of a plurality of grinding micro segments composed of a crushed agglomerate including at least one material selected from the group consisting of metal-bonding or ceramic-bonding materials, and at least one grit material selected from the group consisting of diamond and cubic crystalline borium nitride (CBN), which agglomerate has been one of hot-pressed or sintered without pressure after which the agglomerate has been crushed to provide the crushed agglomerate; and a resin binder for bonding the grinding micro segments together and to the grinding wheel core. A method of manufacturing a grinding tool composed of a core and a grinding rim provided on the core, includes (a) providing a core; (b) providing a material composed of at least one material selected from the group consisting of metal-bonding or ceramic-bonding materials, and at least one grit material selected from the group consisting of diamond and cubic crystalline borium nitride (CBN); (c) providing an agglomerate of the material by one of hot-pressing or sintering without pressure; (d) crushing the agglomerate to provide a plurality of grinding micro segments composed of crushed agglomerate; and (e) bonding the plurality of grinding micro segments together and to the core using a resin binder.

14 Claims, 1 Drawing Sheet

GRINDING WHEEL, GRINDING RIM FOR A GRINDING TOOL, AND METHOD OF MANUFACTURING A GRINDING TOOL

BACKGROUND OF THE INVENTION

1. Field of the Invention

The present invention relates to a grinding rim for grinding tools, in particular grinding wheels.

2. Background of the Related Art

Grinding tools, in particular grinding wheels, which are provided with so-called hot pressed or sintered (without pressure) super abrasives containing diamonds or CBN (cubic crystalline borium nitride), which are metal, resin, or ceramic bonded to the grinding tool, and which are effective as hard, wear-resistant abrasive grit, are commonly used for grinding materials that are difficult to grind, such as cemented carbides, stones tools, and glass, but also high-grade steel, basic steels, and non-ferric metals and their alloys.

Depending on the required bonding, the grit size, and the grit protrusion, such abrasive tools, in particular abrasive wheels, only allow for very small chip clearance spaces so that the grinding wheel is loaded quickly and has to be trued and dressed again. This occurs apart from any other wheel wear phenomenons, in particular heat dissipation in the resin or ceramic grinding rim which is unfavorable here.

SUMMARY OF THE INVENTION

It is therefore the object of the present invention to provide a grinding rim on the kind mentioned above which avoids the said disadvantages of the state of the art and which is characterized by high chip clearance spaces, high wear resistance, self-sharpening, higher mechanical resistance of the grinding wheel, and direct bonding of the rim with the core.

This is achieved in accordance with the invention by providing a grinding rim comprising resin-bonded, grinding micro segments formed by crushing or the like metal-bonding or ceramic-bonded, hot-pressed or sintered (without pressure) abrasive containing diamond or CBN grit.

The different wear characteristics of the wear-resistant grinding area formed by the micro segments and the "soft" bonding system based on resin allows for the formation of high chip clearance spaces. It was noticed further that such a grinding wheel is self-sharpening or self-truing and adapts automatically in an ideal manner via bonding erosion to the chip clearance volume.

Moreover, such an arrangement of the grinding rim in accordance with the invention permits use of a grinding wheel body or core which is itself free of grinding segments. A continuous and thin rim is provided on the grinding wheel body, which leads to simpler production and allows higher stressing of the wheel. As the rim is comparably lighter and more homogenous, such a grinding rim tends to be less untrue which lowers vibrations in use.

In particular, however, the higher mechanical resistance and the excellent combination with the metallic core provide the best prerequisites for use in the field of high-speed grinding.

An embodiment of the grinding rim which is substantial to the invention has a diamond or CBN grit size which is MD20 (20 microns) to D301 (50/60 Mesh) or MB 20 (20 microns) to B 427 (40/50 Mesh). The grinding micro segment size arising from the crushing down of the metal- or ceramic-bonded, hot pressed or sintered (without pressure) abrasives containing diamond or CBN grit should be ¼ to 3 mm. In this respect, it is advantageous that the diamond or CBN concentration in the grinding micro segments does not exceed 8.8 carat per cubic centimeter (FEPA K200 or 480 V) and that the volume percent thereof in the grinding rim is about 30 to 60%.

Furthermore, the present invention relates to a method for manufacturing the grinding rim in accordance with the invention for grinding tools, in particular grinding wheels. This method is characterized in accordance with the invention in that grinding micro segments are formed from a hot-pressed or sintered (without pressure), metal- or ceramic-bonded agglomeration of grinding grits containing diamond or CBN grit and that these are bonded by means of a resin binder and applied to a core.

For the grinding micro segments, it is possible to use an agglomeration of grinding grits in the form of micro pellets having a pellet size ranging from 0.2 to 3 mm or an agglomeration of grinding grits obtained by crushing down of existing or recyclable hot-pressed or sintered (without pressure), metal- or ceramic-bonded grinding rims containing diamond or CBN grit.

The present invention relates further to a grinding wheel produced in accordance with the process in accordance with the invention.

BRIEF DESCRIPTION OF THE DRAWINGS

An exemplary embodiment of the subject matter of the invention is given in more detail in the following with reference to the enclosed drawing, in which.

DETAILED DESCRIPTION OF THE PREFERRED EMBODIMENTS

Figure 1:
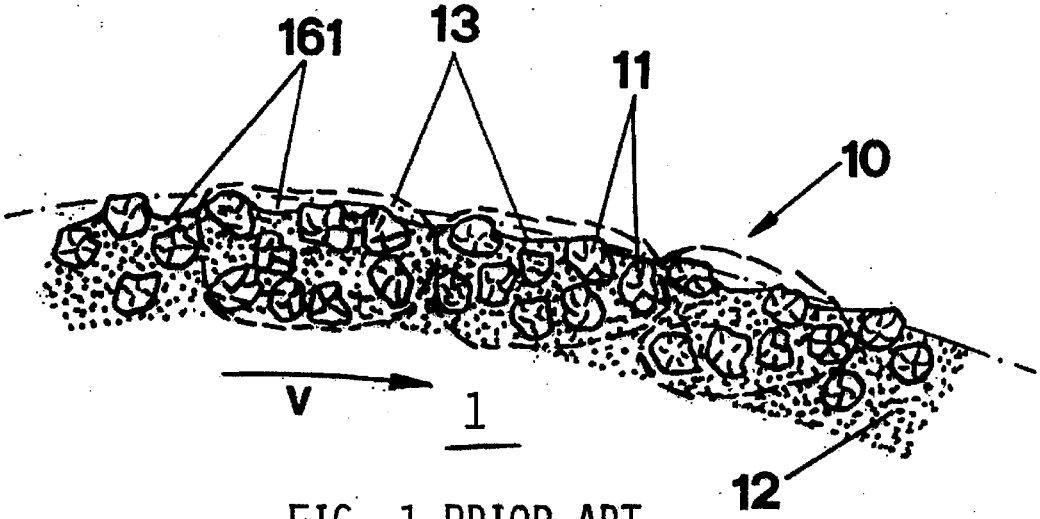
FIG. 1 PRIOR ART
FIG. 1 shows a cross-sectional view of a grinding rim of a grinding wheel in accordance with the state of the art.

The known grinding rim 10 is shown in FIG. 1 and comprises an abrasive containing a diamond or CBN grit 11 which is embedded in a resin, metal or vitrified bonding system 12 and which is connected to grinding rim 10 by means of hot pressing or sintering without pressure.

Grit and binder may be present in the grinding rim 10 at random and may additionally comprise additives, such as supporting grits, fillers, dry lubricants, and softening agents.

Figure 2:
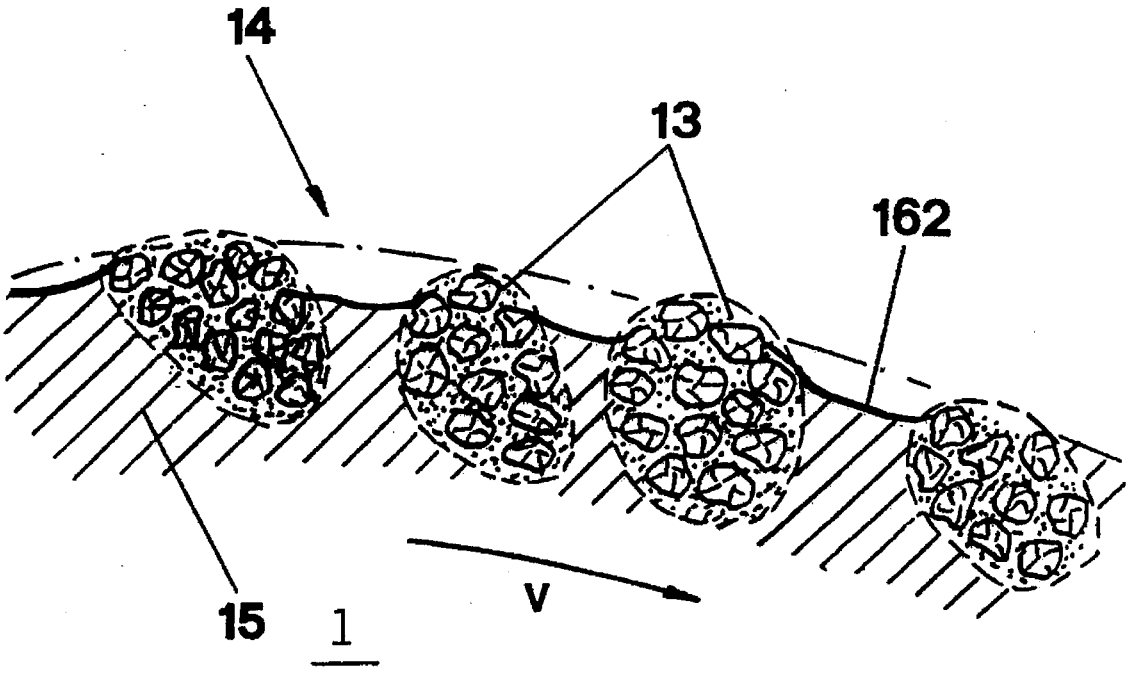
FIG. 2 shows a cross-sectional view of the grinding rim of a grinding wheel in accordance with the invention.

In accordance with the invention, a grinding rim is provided having a crushed form including grinding micro segments 13 for a completely new kind of grinding rim 14 as shown in FIG. 2. The grinding micro segments 13 are bound by means of resin binders 15 and are applied to a core 1 which is an abrasive wheel (grinding wheel) or the like.

For the grinding micro segment 13, it is possible, as was mentioned above, to use an agglomeration of grinding grits in the form of micro pellets of 0.2 to 3 mm or an agglomeration of grinding grits obtained by crushing down of existing or recyclable hot-pressed or sintered (without pressure), metal- or ceramic-bonded grinding rims containing diamond or CBN grit.

A comparison of the grinding rims of FIGS. 1 and 2 shows that the chip clearance spaces 162 are substantially larger in the grinding rim of FIG. 2 in accordance with the invention as compared with the clearance spaces 161 of FIG. 1 according to the prior art. The advantages of the present invention were mentioned in the introduction, as were the useful grit sizes and volume proportions.

The representation in accordance with FIG. 2 further suggests that better heat dissipation is obtainable by including the grinding micro segments 13 formed from the initial granulate. The heat is distributed within the grinding micro segments and thus protects the bonding system 15.

It is further to be seen in FIG. 2 that only micro segments 13 would grind on the workpiece (not shown), which has a favorable effect on the life of such a rim.

It is understood that it is also possible and within the scope of the invention to include other super abrasives comparable to diamond or CBN.

While there are shown and described preferred embodiments of the invention, it is to be distinctly understood that the invention is not limited thereto but may be embodied and practised within the scope of the following claims.

What I claim:

1. A grinding wheel for a grinding tool, comprising:

a grinding wheel core; and a grinding rim which is provided on the grinding wheel core and which is comprised of:

a plurality of grinding micro segments composed of a crushed agglomerate comprising at least one material selected from the group consisting of metal-bonding or ceramic-bonding materials, and at least one grit material selected from the group consisting of diamond and cubic crystalline borium nitride (CBN), which agglomerate has been one of hot-pressed or sintered without pressure after which the agglomerate has been crushed to provide the crushed agglomerate; and a resin binder for bonding the plurality of grinding micro segments together and to the grinding wheel core, wherein the at least one grit material has a concentration in the agglomerate which does not exceed 8.8 carat per cubic centimeter (FEPA K200 or 480 V), and wherein the plurality of grinding micro segments have a volume percent in the grinding rim which ranges from about 30 to 60%.

2. The grinding wheel according to claim 1, wherein the at least one grit material has a particle size ranging from 20 microns (measured by MD20) up to a size that will pass through a screen which is 50/60 mesh (measured by D301).

3. The grinding wheel according to claim 1, wherein the at least one grit material has a particle size ranging from 20 microns (measured by MB20) up to a size that will pass through a screen which is 40/50 mesh (measured by B 427).

4. The grinding wheel according to claim 1, wherein the plurality of grinding micro segments have a size which ranges from about ¼ to 3 mm.

5. The grinding wheel according to claim 1, wherein the plurality of grinding micro segments are micropellets having a pellet size which ranges from 0.2 to 3 mm.

6. The grinding wheel according to claim 1, wherein the plurality of grinding micro segments are comprised of crushed, recycled grinding rims.

7. The grinding wheel according to claim 1, wherein the grinding wheel core is free of grinding segments.

8. A grinding rim provided on a core of a grinding tool, comprising:

a plurality of grinding micro segments composed of a crushed agglomerate comprising at least one material selected from the group consisting of metal-bonding or ceramic-bonding materials, and at least one grit material selected from the group consisting of diamond and cubic crystalline borium nitride (CBN), which agglomerate has been one of hot-pressed or sintered without pressure after which the agglomerate has been crushed to provide the crushed agglomerate; and a resin binder for bonding the plurality of grinding micro segments together and to the core of the grinding tool, wherein the at least one grit material has a concentration in the agglomerate which does not exceed 8.8 carat per cubic centimeter (FEPA K200 or 480 V), and wherein the plurality of grinding micro segments have a volume percent in the grinding rim which ranges from about 30 to 60%.

9. The grinding rim according to claim 8, wherein the at least one grit material has a particle size ranging from 20 microns (measured by MD20) up to a size that will pass through a screen which is 50/60 mesh (measured by D301).

10. The grinding rim according to claim 8, wherein the at least one grit material has a particle size ranging from 20 microns (measured by MB20) up to a size that will pass through a screen which is 40/50 mesh (measured by B 427).

11. The grinding rim according to claim 8, wherein the plurality of grinding micro segments have a size which ranges from about ¼ to 3 mm.

12. The grinding rim according to claim 8, wherein the plurality of grinding micro segments are micropellets having a pellet size which ranges from 0.2 to 3 mm.

13. The grinding wheel according to claim 8, wherein the plurality of grinding micro segments are comprised of crushed, recycled grinding rims.

14. The grinding rim according to claim 8, wherein the core is free of grinding segments.

* * * * *